United States Patent [19]

Desdoigts et al.

[11] Patent Number: 4,801,011

[45] Date of Patent: Jan. 31, 1989

[54] PROTECTIVE CONTAINER FOR A FILM CARTRIDGE

[75] Inventors: Olivier P. C. Desdoigts; Francis Metzler, both of Paris, France

[73] Assignee: Eastman Kodak Company, Rochester, N.Y.

[21] Appl. No.: 136,075

[22] Filed: Dec. 21, 1987

[30] Foreign Application Priority Data

Feb. 23, 1987 [FR] France ..... 87 02360

[51] Int. Cl.[4] ..... B65D 85; B65D 38

[52] U.S. Cl. ..... 206/316; 224/252; 224/253

[58] Field of Search ..... 224/236, 252, 253, 240; 206/316

[56] References Cited

U.S. PATENT DOCUMENTS

| | | | |
|---|---|---|---|
| 984,927 | 3/1965 | Razzell . | |
| 1,214,161 | 1/1917 | Hettinger et al. | 224/252 |
| 1,815,101 | 7/1931 | Goldstein . | |
| 2,124,945 | 7/1938 | Gross | 224/253 |
| 2,392,507 | 1/1946 | Sebell | 215/95 |
| 2,852,054 | 9/1958 | Motley | 150/5 |
| 3,021,101 | 2/1962 | Gliebe | 224/253 |
| 3,121,508 | 2/1964 | Kase | 224/240 |
| 3,250,448 | 5/1966 | Clark | 224/282 |
| 3,813,017 | 5/1974 | Pimsleur | 224/240 |
| 3,927,784 | 12/1975 | Cochrane | 215/256 |
| 3,970,228 | 7/1976 | Keller | 224/253 |
| 4,406,385 | 9/1983 | Pribyl | 224/252 |
| 4,479,596 | 10/1984 | Swanson | 224/236 |
| 4,639,386 | 1/1987 | Akao | 428/35 |
| 4,667,374 | 5/1987 | Bianchi | 224/252 |

FOREIGN PATENT DOCUMENTS

| | | |
|---|---|---|
| 1705979 | 9/1955 | Fed. Rep. of Germany . |
| 7530563 | 1/1976 | Fed. Rep. of Germany . |
| 3147097 | 6/1983 | Fed. Rep. of Germany . |
| 2261937 | 2/1974 | France . |
| 24496111 | 2/1979 | France . |
| 2543351 | 3/1983 | France . |
| 2545451 | 2/1984 | France . |
| 2156205 | 3/1985 | United Kingdom . |

*Primary Examiner*—Joseph Man-Fu Moy
*Attorney, Agent, or Firm*—Roger A. Fields

[57] ABSTRACT

A protective container for a film cartridge includes a cannister adapted to store the cartridge and a clip member integrally formed with the cannister for securing the cannister to the shoulder strap of a camera case or the like. The clip member has a flexible hinge-like portion which permits the clip member to be pivoted away from the cannister to release the cannister from the strap. A press-on cap for closing the cannister has a cavity adapted to receive a reversible insert label upon which information pertaining to the film cartridge may be hand-written.

3 Claims, 3 Drawing Sheets

PROTECTIVE CONTAINER FOR A FILM CARTRIDGE

BACKGROUND OF THE INVENTION

1. Field of the Invention

The invention relates generally to the field of containers and more particularly to a protective container for a film cartridge.

2. Description of the Prior Art

A typical container for a 35 mm film cartridge comprises an open cylindrical receptacle, commonly referred to as a "can", for storing the film cartridge, and a press-on cap which covers the opening to the can to provide a moisture-proof light seal. An example of such a container is disclosed in U.S. Pat. No. 4,639,386, granted Jan. 27, 1987. The can and the cap are usually molded from a plastic material, e.g., polyethylene, which is moisture proof, opaque, and chemically inert.

When a photographer wants to carry one or more of these containers, they are usually kept in his or her pocket or in a camera bag. Alternatively, a container has been proposed, such as disclosed in Ger. Gebrauchsmuster No. 75 30 563, published Jan. 22, 1976, which includes a clip member for securing the container to the shoulder strap of a camera bag. However, the clip member because of its design appears to be difficult to attach to and separate from the strap, and may be broken during the process.

Another problem with these containers is that they often do not include any surface upon which information pertaining to the contents of the container can be hand-written. As a solution, U.S. Pat. No. 2,852,054, granted Sept. 16, 1958, suggests that the press-on cap for a container include a dovetailed recess for receiving a snap-in insert label which may be written upon to indicate the contents of the container. However, once the label is inserted into the dovetailed recess it is not certain that the label can be readily removed from the recess, particularily without damaging the label.

SUMMARY OF THE INVENTION

The invention is believed to solve the above-described problems existing in connection with known protective containers for film cartridges.

According to the invention, there is provided an improved container for a film cartridge, wherein said container is generally of the type having (a) an elongate cannister including an upper portion which has an opening for placing the film cartridge into said cannister and a bottom portion which is closed to support the film cartridge, and (b) a cap adapted to cover said opening to seal said cannister, and wherein the improvement comprises:

a substantially flat clip member integrally formed with said cannister of the same material, said clip member being united with said cannister generally at said upper portion of the cannister and including an elongate main portion normally extending lengthwise of said cannister in spaced facing relation, a bottom free end portion normally extending alongside said bottom portion of the cannister, and a flexible hinge-like portion arranged adjacent said main portion and substantially spaced from the location at which said clip member is united with said cannister for permitting only said main portion and said free end portion to be pivoted away from the cannister to open a slot for a strap or the like defined by said cannister and said clip member; and mutually engageable means arranged on said bottom portion of the cannister and said free end portion of the clip member for releasably connecting the bottom portion and the free end portion to prevent said free end portion from being pivoted to open said slot.

The protective container is further improved by providing the cap with a cavity that houses an insert label having one side upon which information may be hand-written and another side bearing information regarding the film cartridge, said cavity being surrounded by an elastic wall of the cap which can be deformed to readily remove said insert label from the cavity to re-position the insert label in the cavity with a selected one of its sides exposed for viewing.

DESCRIPTION OF THE PREFERRED EMBODIMENT

Figure 1:
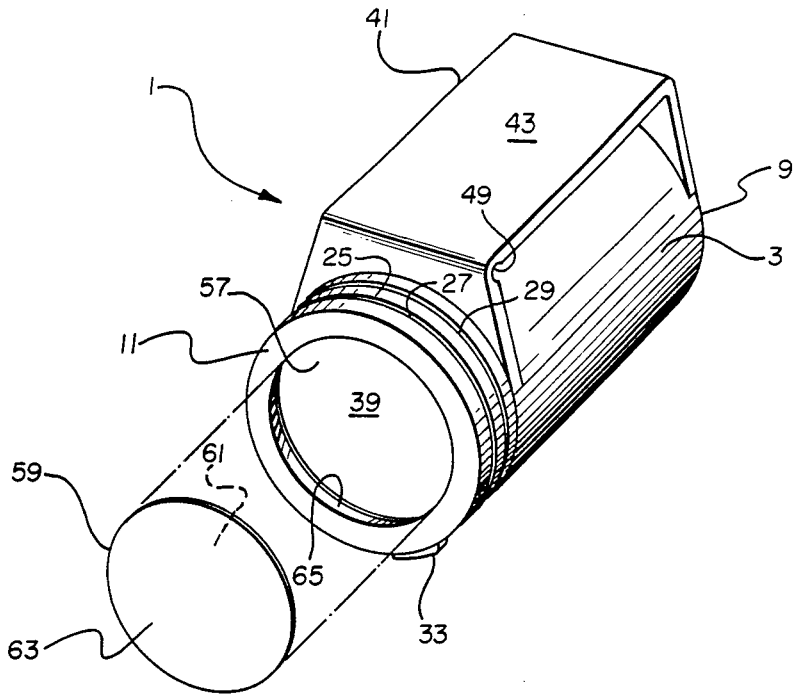
FIG. 1 is a perspective view, partly exploded, of a protective container according to a preferred embodiment of the invention.
Figure 2:
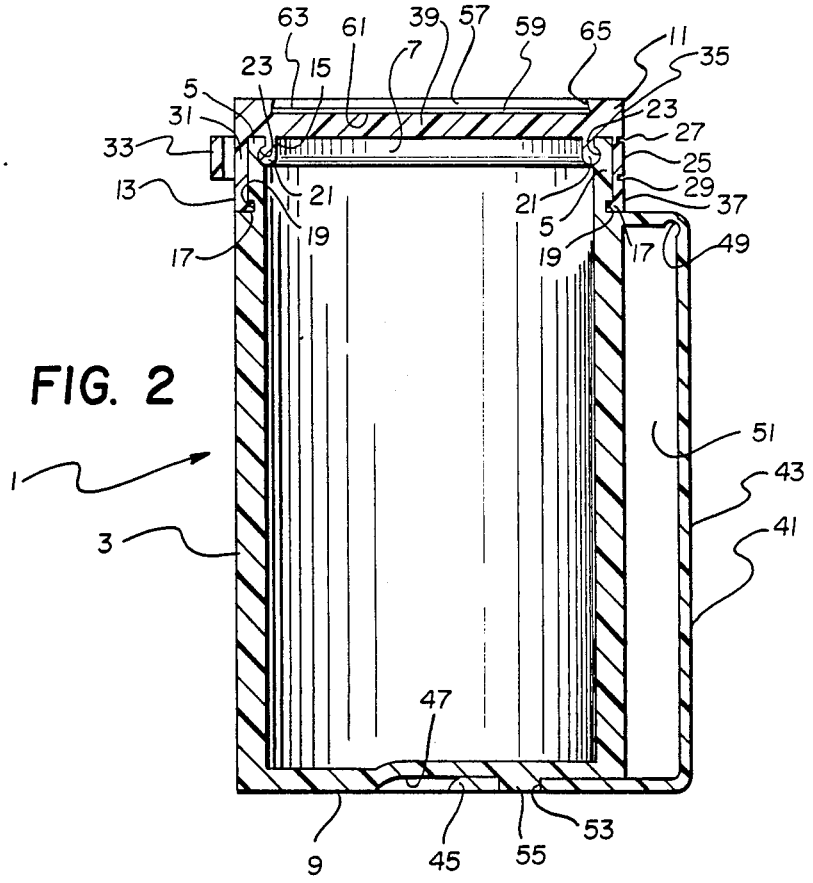
FIG. 2 is an elevation view, in crosssection, of the container.

Referring now to the drawings, and in particular to FIGS. 1 and 2, there is illustrated a protective container 1 for a conventional 35 mm film cartridge, not shown. The container 1 comprises an elongate cylindrical shaped cannister 3 including an upper neck portion 5 which has an opening 7 for placing the film cartridge lengthwise into the cannister, and a bottom or base portion 9 which is closed to support the film cartridge. A press-on cap 11 is adapted to cover the opening 7 to seal the cannister 3 from moisture and light.

As shown in FIG. 2, the cap 11 has an outer annular skirt 13 and a relatively shorter, concentric, inner annular skirt 15 which are spaced apart from each other to receive the upper neck portion 5 of the cannister 3 between the two skirts as the cap is pressed onto the upper neck portion. When the cap 11 is pressed onto the upper neck portion 5, a circumferential rib 17 on the interior side of the outer skirt 13 will be received in a circumferential groove 19 in the exterior side of the upper neck portion 5, and a circumferential bead 21 on the exterior side of the inner skirt 15 will be received in a circumferential groove 23 in the interior side of the upper neck portion. This secures the cap 11 to the cannister 3 to seal the cannister from moisture and light.

Figure 4:
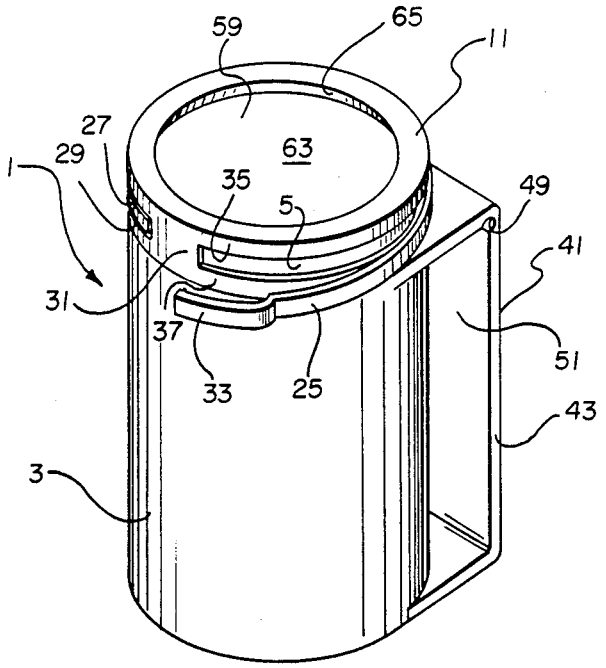
FIG. 4 is a perspective view of the container, showing a tear band partially removed from a cap.
Figure 5:
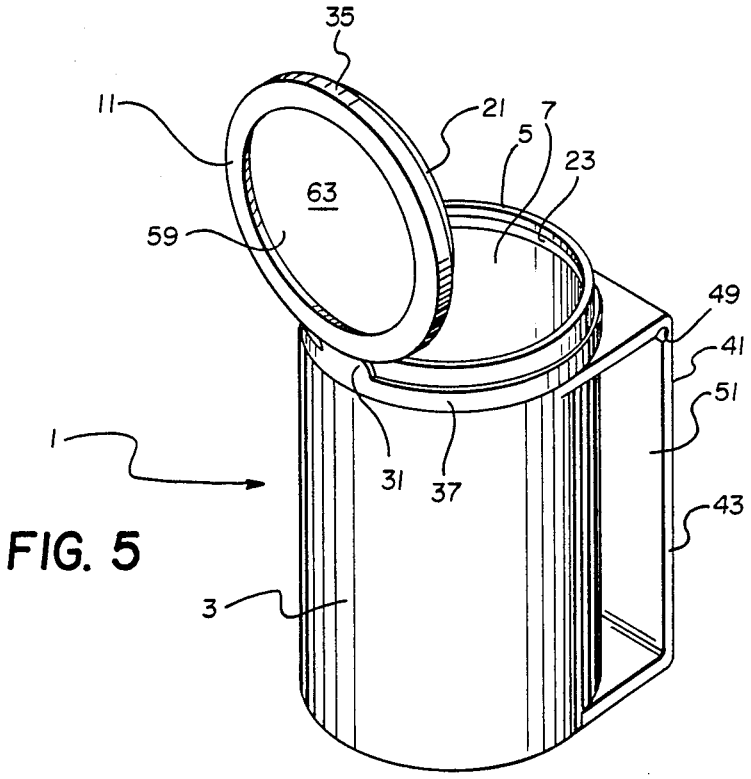
FIG. 5 is a perspective view of the container, showing the tear band completely removed and the cap opened.

A partially circumferential tear band 25 of the outer skirt 13, similar in certain respects to the ones disclosed in U.S. Pat. No. 3,927,784, granted Dec. 23, 1975, and U.S. Pat. No. 2,392,507, granted Jan. 8, 1946, is defined by upper and lower parallel score lines 27 and 29 on the exterior side of the outer skirt. See FIGS. 2, 4 and 5. The tear band 25 has opposite ends, not shown, which are separated by a hinge or flexible section 31 of the outer skirt 13. The hinge section 31 is located behind a pull tab 33 on the tear band 25. When the tab 33 is pulled away from the cap 11, the tear band 25 will be removed from the outer skirt 13, leaving an upper annular portion 35 and a lower annular portion 37 of the outer skirt spaced from each other except for their connection at the hinge section 31. The lower annular portion 37 of the outer skirt 13 remains secured to the upper neck portion 5 of the cannister 3 because of the engagement of the rib 17 and the groove 19. See FIG. 2. Conversely, the upper annular portion 35 of the outer skirt 13 is not secured to the upper neck portion 5 of the cannister 3. See FIG. 2. This relation permits a top or cover section 39 of the cap 11 to be pivoted, generally at the hinge section 31, away from the upper neck portion 5 to uncover the opening 7 of the neck portion. See FIG. 5.

Figure 3:
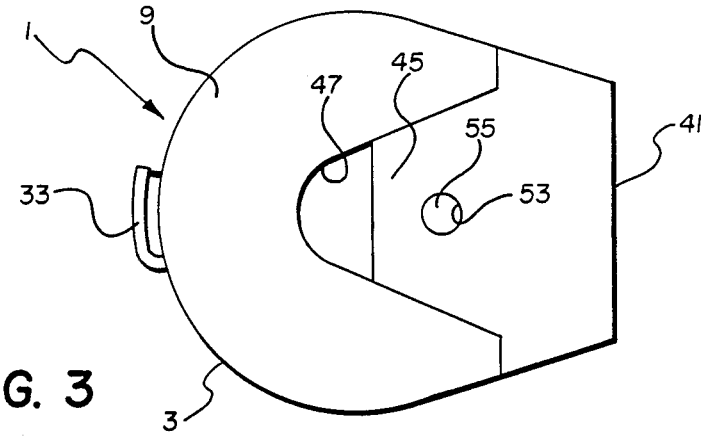
FIG. 3 is a bottom plan view of the container.

As shown in FIGS. 1-3, a substantially flat clip member 41 is integrally formed with the cannister 3 of the same material, e.g., polyethylene. The clip member 41 is united with the cannister 3 at the upper neck portion 5 of the cannister and it includes an elongate main portion 43 normally extending lengthwise of the cannister in spaced facing relation, a bottom free end portion 45 normally received in a recess 47 at the bottom portion 9 of the cannister, and a flexible hinge-like portion 49 arranged between the main portion and the location at which the clip member is united with the cannister, thereby effecting a slot or space 51 between the clip member and the cannister for receiving a belt or a strap or the like, not shown. The flexible hinge-like portion 49 of the clip member 41 permits the main portion 43 and the free end portion 45 of the clip member to be pivoted away from the cannister 3 to open the slot 51 to remove the protective container 1 from the belt or strap.

Mutually engagable means in the form of a round hole 53 in the free end portion 45 of the clip member 41 and a mating projection 55 in the recess 47 at the bottom portion 9 of the cannister 3 couple to connect the free end portion and the bottom portion to prevent the free end portion from being pivoted to open the slot 51. However, these engageable means can be readily separated to permit the slot to be opened.

When the round hole 53 in the free end portion 45 of the clip member 41 and the mating projection 55 in the recess 47 at the bottom portion 9 of the cannister 3 are coupled, a flush relation exists between the bottom and free end portions as shown in FIG. 2. This enables the cannister 3 to stand upright without any difficulty.

As shown in FIGS. 1 and 2, the cap 11 includes a cavity 57 housing a flexible cardboard insert disc or label 59 having one flat side 61 on which information may be hand-written and another flat side 63 bearing manufacturer information pertaining to the film cartridge. The cavity 57 is surrounded by an elastic annular wall 65 which can be deformed to readily remove the disc 59 from the cavity in order to re-position the disc in the cavity with a selected one of its sides 61 or 63 exposed for viewing.

Accordingly, it will be appreciated that the protective container 1 affords numerous advantages. For example, the cap 11 is made inviolable by means of the tear band 25. The clip member 41 defines with the cannister 3 a slot 51 for a belt or strap or the like, and the slot can easily be opened to remove the protective container from the belt or strap. The disc label 59 is reversible to alternately view the information on it.

The invention has been described with reference to a preferred embodiment. However, it will be understood that variations and modifications of the preferred embodiment can be effected without departing from the scope of the invention.

We claim:

1. An improved protective container for a film cartridge, wherein said container is of the type provided with (a) an elongate cannister including an upper portion which has an opening for placing the film cartridge into said cannister and a bottom portion which is closed to support the film cartridge, and (b) a cap adapted to cover said opening to seal said cannister, and wherein the improvement comprises:

a substantially flat clip member integrally formed with said cannister of the same material, said clip member being united with said cannister generally at said upper portion of the cannister and including an elongate main portion normally extending lengthwise of said cannister in spaced facing relation, a bottom free end portion normally extending alongside said bottom portion of the cannister, and a hinge-like portion arranged adjacent said main portion and substantially spaced from the location at which said clip member is united with said cannister for permitting only said main portion and said free end portion to be pivoted away from the cannister to open a slot for a strap or the like defined by said cannister and said clip member;

mutually engagable means arranged on said bottom portion of the cannister and said free end portion of the clip member for releasably connecting the bottom portion and the free end portion to prevent said free end portion from being pivoted to open said slot; and means defining a recess at said bottom portion of the container for receiving said free end portion of the clip member in flush relation with the bottom portion to enable said cannister to stand upright when said bottom and said free end portions are connected.

2. The improvement as recited in claim 1, wherein said main portion and said hinge-like portion of the substantially flat clip member have respective widths which are coextensive.

3. The improvement as recited in claim 1, wherein said cap includes a cavity housing an insert label having one side upon which information may be hand-written and another side bearing information regarding the film cartridge, said cavity being surrounded by an elastic wall which can be deformed to remove said insert label from the cavity to re-position the insert label in the cavity with a selected one of its sides exposed for viewing.

* * * * *